US006679171B2

(12) United States Patent
Mayer et al.

(10) Patent No.: US 6,679,171 B2
(45) Date of Patent: Jan. 20, 2004

(54) METHOD OF CONTROLLING AN INK LAYER ON A PRINTING FORM OF A PRINTING MACHINE

(75) Inventors: Martin Mayer, Ladenburg (DE); Nikolaus Pfeiffer, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 122 days.

(21) Appl. No.: 09/799,545

(22) Filed: Mar. 5, 2001

(65) Prior Publication Data

US 2001/0032562 A1 Oct. 25, 2001

(30) Foreign Application Priority Data

Mar. 3, 2000 (DE) ..... 100 10 412

(51) Int. Cl.[7] ..... B41F 31/14
(52) U.S. Cl. ..... 101/484; 101/365; 101/DIG. 47
(58) Field of Search ..... 101/365, 483, 101/484, 485, DIG. 45, DIG. 47

(56) References Cited

U.S. PATENT DOCUMENTS

| | | | | |
|---|---|---|---|---|
| 4,656,941 A | * | 4/1987 | Brovman | 101/365 |
| 5,170,711 A | | 12/1992 | Maier et al. | 101/365 |
| 5,182,721 A | * | 1/1993 | Kipphan et al. | 101/484 |
| 5,689,425 A | * | 11/1997 | Sainio et al. | 101/181 |
| 5,724,259 A | * | 3/1998 | Seymour et al. | 101/211 |
| 5,802,978 A | * | 9/1998 | Geissler et al. | 101/365 |
| 5,870,529 A | * | 2/1999 | Kistler et al. | 101/365 |
| 5,967,049 A | * | 10/1999 | Seymour et al. | 101/365 |
| 5,967,050 A | * | 10/1999 | Seymour | 101/365 |
| 6,024,018 A | * | 2/2000 | Darel et al. | 101/365 |
| 6,142,078 A | * | 11/2000 | Lachajewski | 101/211 |
| 6,318,260 B1 | * | 11/2001 | Chu et al. | 101/365 |
| 6,422,142 B2 | * | 7/2002 | Steinbacher | 101/211 |

FOREIGN PATENT DOCUMENTS

| | | | |
|---|---|---|---|
| DE | 4004056 A1 | * | 8/1991 |
| DE | 19533822 A1 | * | 3/1997 |
| DE | 19602103 A1 | * | 7/1997 |
| DE | 196 02 103 | | 7/1997 |
| EP | 0 228 347 | | 7/1987 |
| EP | 0228347 B2 | * | 11/1996 |
| EP | 0 881 076 A1 | | 12/1998 |

* cited by examiner

*Primary Examiner*—Stephen R. Funk
*Assistant Examiner*—Leo Hinze
(74) *Attorney, Agent, or Firm*—Laurence A. Greenberg; Werner H. Stemer; Gregory L. Mayback

(57) ABSTRACT

A method of controlling parameters of an ink layer at a selected location in a printing unit of a printing machine, the printing machine including at least one ink source for producing the ink layer on a transport device, whereon metering variables for regulating the application of ink to the transport device are zonally settable, and further including the transport device for transferring the ink layer to the selected location. The method includes, for each zone of the ink layer, using a subject to be printed for determining desired values of parameters which the ink layer is to have at the selected location, and setting the metering variables of the ink source, based upon the desired values of the parameters, so that the parameters of the ink layer as the ink layer is applied to the transport device have temporary values deviating from the desired values, the deviation being such that an exchange of ink between the zones, taking place in the transport device, leads to the ink layer reaching the desired values of the parameters as the ink layer is transferred to a printing form.

8 Claims, 6 Drawing Sheets

METHOD OF CONTROLLING AN INK LAYER ON A PRINTING FORM OF A PRINTING MACHINE

BACKGROUND OF THE INVENTION

Field of the Invention

The invention relates to a method of controlling an ink layer on a printing form of a printing machine and, thereby, controlling color reproduction of a printing machine.

Within the context of the invention of the instant application, a printing machine can be regarded in very simplified form as including three components for each color to be printed, namely the printing form or plate, an ink source supplying the printing ink, and a transport device for transferring ink discharged by the ink source to the printing form or plate in the form of an ink layer.

During printing, individual printing inks are often distributed very non-uniformly in a subject to be printed. A consequence thereof is that the printing form or plate accepts a large quantity of ink from the transport device in some areas, while in other areas little or no ink is accepted. This can lead to a non-uniform distribution of the ink layer on the transport device, so that ink from the heavily inked areas of the transport device can possibly pass over to areas of the printing form or plate where it is not desired. The result may be a faulty, spotty printed image.

Metering of ink from the ink source to the transport device is generally performed zonally, i.e., zone by zone. Zones which correspond to areas in the printing image wherein the relevant color is represented only to a limited extent are supplied with a lesser quantity of ink than other zones.

In order to prevent boundaries between two zones from becoming visible in the printed image during the zonal metering, it is necessary to distribute the ink, which has been applied to the transport device, transversely to the printing direction on the path of the ink from the ink source to the printing form. The transverse distribution causes the quantity of ink which is transferred to the printing form in a zone defined by the transport device to be only to some extent the same as that which was applied by the ink source to the same zone of the transport device. Part of the ink originally applied into the zone has been displaced into adjacent zones by the distribution, and parts of ink layers originally applied to adjacent zones have been intermixed.

Moreover, inking-unit simulation programs have become known heretofore which permit the calculation of nominal or desired values for the ink metering, which should be complied with in order to achieve a good printed result, based upon a large number of variables, such as the type of printing ink used, the type of printing material, the moisture content, the sequence of colors during printing, and so forth. These programs describe the chronological development of the ink layer thicknesses in an inking unit in the course of a printing operation, starting from an initial distribution of the ink, metering thereof by the inking unit, and acceptance of ink by the printed material and, for this purpose, calculate step by step the effects of each movement of the inking unit on the ink distribution. With the aid of this model it is possible to calculate a set of metering variables to be adjusted at the ink source for the various printing inks for the purpose of ink presetting at the beginning of a printing job. Because these programs calculate the chronological development of the ink layer thicknesses numerically, and because the number of printing operations needed to achieve a steady state of the printing machine can run up to 1000 sheets or more, the computing effort associated with the use of these programs is enormous. Controlling production printing by using such programs is therefore not economically possible.

The published European Patent Document EP 0 228 347 B1, and the published German Patent Documents DE 195 33 822 A1 and DE 196 02 103 A1 disclose methods of controlling or regulating the color reproduction of a printing machine in production printing. In these methods, at selected points of a printed image, color values are measured and compared with corresponding values from an original. Depending upon the type of the established deviation, the metering of individual printing inks is varied in order to match the printed result to the desired or nominal value.

In this regard, the problem arises that, if a color deviation is registered in a given zone, and the ink metering for the relevant zone is correspondingly changed, this change influences a large number of other zones because of the ink exchange caused by the distribution. For example, eliminating a color deviation in one zone can readily lead to color errors then occurring in one or more other zones which previously supplied a printing result satisfactory in terms of color. A renewed correction of these color errors can, in, turn react on the zone considered first, and on further zones. There is thus the risk of the entire color regulation becoming unstable and the printed results becoming completely unusable and, even if ultimately metering variables are found which supply satisfactory color reproduction for the entire image to be printed, this is nevertheless preceded by a lengthy regulating process, in the course of which a great number of rejects have been produced. In addition, the extent of the correction needed to eliminate a given deviation depends upon settings of the transport system, such as lateral distribution and dampening. Each change in these settings of the ink transport system therefore necessitates renewed learning of the relationships between the extent of the error and the extent of the correction.

Both when determining presettings for a printing machine and during the continuous readjustment of the settings of the machine, the problem therefore arises that the settings and the color values obtained therewith in the printed result are interrelated in an extremely complicated manner.

When determining the presettings by simulation, the user can initially select only more-or-less arbitrarily setting values for which he or she causes the simulation to be performed, can estimate, based upon the simulation result, what setting or settings may possibly have to be changed in order to improve the color reproduction, and can repeat the simulation with accordingly changed settings. By performing a great number of simulations, it is then ultimately possible to find a set of presettings which promises satisfactory results; it is, however, not possible to assess whether this set is the best possible.

Even when regulating the settings during production printing, if a deviation from the desired color reproduction is determined, it is not directly possible for a correction to the settings to be specified which promises to correct only the determined deviation accurately and without any disruptive accompanying phenomena. Instead, it is possible only to feel one's way to the desired or nominal color reproduction step by step by observing the effects of changes to the settings.

SUMMARY OF THE INVENTION

It is accordingly an object of the invention to provide a method of controlling an ink layer on a printing form of a printing machine which avoids the aforementioned disadvantages heretofore known in the prior art.

With the foregoing and other objects in view, there is provided, in accordance with the invention, a method of controlling parameters of an ink layer at a selected location in a printing unit of a printing machine, the printing machine including at least one ink source for producing the ink layer on a transport device, whereon metering variables for regulating the application of ink to the transport device are zonally settable, and further including the transport device for transferring the ink layer to the selected location, the method comprising, for each zone of the ink layer, using a subject to be printed for determining desired values of parameters which the ink layer is to have at the selected location, and setting the metering variables of the ink source, based upon the desired values of the parameters, so that the parameters of the ink layer as the ink layer is applied to the transport device have temporary values deviating from the desired values, the deviation being such that an exchange of ink between the zones, taking place in the transport device, leads to the ink layer reaching the desired values of the parameters as the ink layer is transferred to a printing form.

In accordance with another mode, the method invention includes calculating the temporary values with the aid of a system of linear equations describing the parameters of the ink layer in the entire inking unit in a stationary state based upon the temporary values, taking into account ink splitting and lateral distribution.

In accordance with a further mode, the method invention includes solving the system of equations for the temporary values in order to calculate the temporary values for given desired values.

In accordance with an added mode, the method invention includes assuming that the ink splitting in the entire printing machine is half and half.

In accordance with an additional mode, the method invention includes applying the method for regulating production printing.

In accordance with yet another mode, the method invention includes applying the method for print presetting.

In accordance with yet a further mode, the method invention includes controlling the parameters at the selected location selected from the group thereof consisting of the printing material, a blanket cylinder and the printing form.

In accordance with yet an added mode, the method invention includes calculating the temporary values while taking into account at least one of the parameters of the ink layer consisting of the thickness and the dampening solution content thereof.

In accordance with a concomitant mode, the method invention includes using the averages of the degree of coverage of the printing inks for each zone for determining the temporary values.

The method invention of the instant application thus determines desired or nominal values of parameters of the ink layer which the ink layer is to have as it is transferred to the printing form or plate, by using the desired or nominal values to calculate so-called temporary values which the parameters must have when the ink layer is produced in order that the desired or nominal values be met at the time of transfer of the ink layer to the printing form or plate, and by setting the metering variables in order to produce the ink layer with the temporary values.

This method is suitable for determining presettings and also for regulating the settings during production printing.

In the first case, the determination of the desired or nominal values is based upon data from the printing original.

When the method is used for regulating the settings during production printing, a printed image of the subject is measured in order to determine the desired or nominal values. In the event of a deviation between the printed image and the original, the desired or nominal values are redetermined based upon the current values of the parameters and the determined deviation.

In order to be able to determine the temporary values, it is expedient to determine, for each zone, that percentage proportion of a quantity of ink applied in this zone by the ink source which is transferred onto the printing plate in this zone and in the other zones. These proportions depend upon the printing parameters (lateral distribution, moisture content) and the subject. The determination of this relationship can be performed empirically or computationally or by a combination of the two, for example, by computational interpolation of empirical data. It is obvious that such a computation requires significantly less time than the aforedescribed, previously conventional type of optimization which, for each optimization step, required the printing of at least one proof and the evaluation of the colors thereof.

A particularly rapid option for finding the suitable temporary values for a given set of desired values is to form a vector from the desired values and to multiply this vector by a square matrix. A suitable square matrix can be found in a straightforward manner by combining the determined proportions for the ink transfer between the various zones into a matrix, and by inverting this matrix.

Stated in more concrete terms, a required inking zone opening is determined by describing the stationary state of the inking unit as a system of equations. In this case, in order to simplify the mathematical description, half-and-half ink splitting is preferably assumed.

The ink layer thicknesses, respectively, in one zone on a pair of rollers is then described by $$SD_i=0.5(SD_j+SD_k),$$

where $SD_j$ and $SD_k$ respectively refer to layer thicknesses on the rollers before a splitting point between these rollers, and $SD_i$ refers to the identical layer thicknesses on the two rollers downline from the splitting point.

In the case of an inking unit having n zones and m splitting points between ink source and printing material, it is possible to set up n(m−1) equations of the above type. These equations correspond to nm unknowns. The system of equations therefore has m free parameters, for example, the ink layer thicknesses in the individual zones on the printing material, which can be defined. By solving the system of equations obtained in this manner, the layer thicknesses at all points in the inking unit and, in particular, on the first roller thereof before the passage through the first splitting point, i.e., the temporary values, can be determined.

Other features which are considered as characteristic for the invention are set forth in the appended claims.

Although the invention is illustrated and described herein as a method of controlling an ink layer on a printing form of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
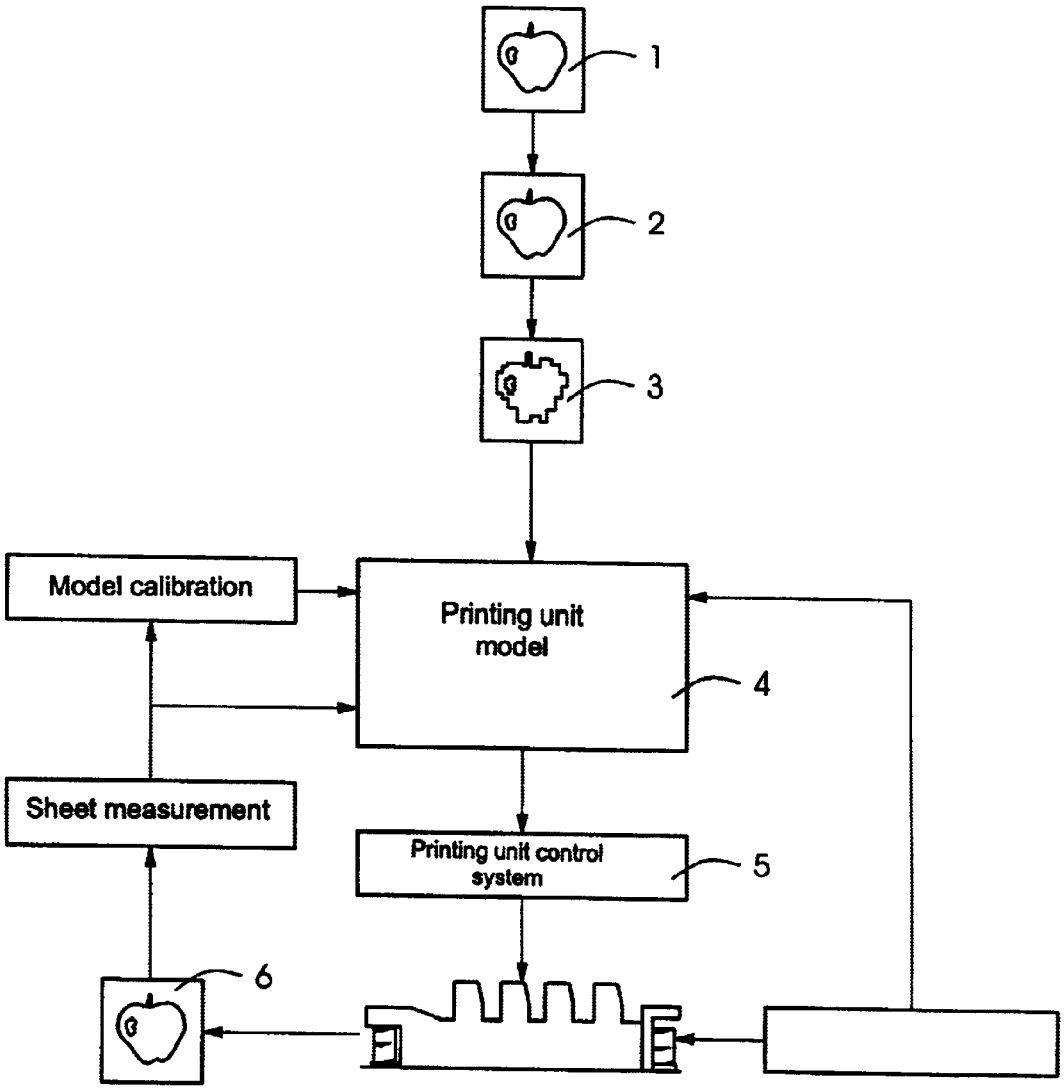
FIG. 1 is a block diagram showing the individual logical stages of color control on a printing machine.

Referring now to the figures of the drawings and, first, particularly to FIG. 1 thereof, there are illustrated therein the logical steps in color presetting and color control of a printing machine, which will be explained briefly hereinafter. The starting point is an original image 1, i.e., an image which is to be duplicated by printing with the most exact reproduction possible of the hues or color tones thereof. This original image is initially measured in a conventional manner, and a color separation 2 is produced representing a data set which, for each point on the original image, specifies the degree of saturation of the colors to be used during printing, namely, in this case, the primary colors cyan, magenta and yellow, as well as black.

This color separation is subdivided into a number of zones. Each of these zones corresponds to a zone of the printing machine, which, respectively, is supplied with printing ink independently of the other zones. These zones are strip-shaped and extend in the printing direction.

For each of these zones, the color values of the color separation are averaged, the average value which is obtained serving to supply a measure for the expected consumption of the relevant ink in this zone and thus for the quantity of ink which should be discharged by the ink source for the relevant zone. This stage is symbolized in FIG. 1 by the box 3.

According to the invention, a printing-unit model 4 in the form of a computer program, for the zonally obtained averages, taking into account diverse boundary conditions such as the material to be printed, specific properties of the inks to be used, and so forth, permits values of adjustable parameters of the ink source to be defined in such a way that the source supplies an ink layer which should be suitable for a true-color print. The parameters of the ink layer to be defined for this purpose are, for example, the thickness of the applied ink layer, the ink-strip width or the like.

The printing-unit model may include a conventional printing-unit simulation program of the type mentioned at the introduction hereto, but may also apply a method as described below with reference to FIG. 4 and the following figures.

The metering variables obtained in this manner for the ink source, as well as other adjustable parameters of the printing machine, are transferred to a printing-unit control system 5, and permit a precise presetting of the printing machine even before the start of the actual printing job. The printing result 6 which is obtained can be measured optically, in order to determine color deviations from the original image and to recorrect the printing-unit model 4 appropriately.

Figure 2:
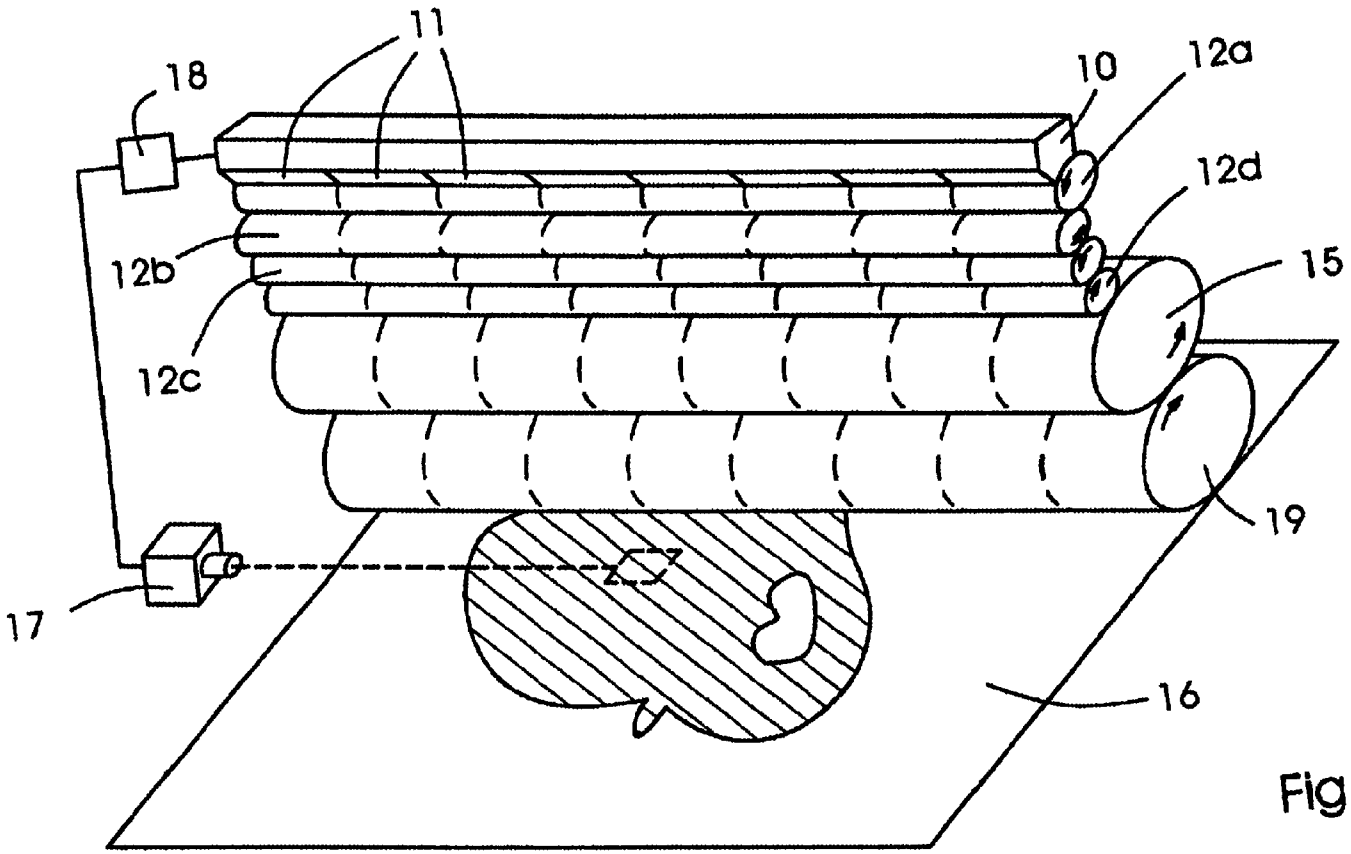
FIG. 2 is a diagrammatic and schematic top, front and side perspective view of a printing unit for one color in a printing machine suitable for performing the method according to the invention.

FIG. 2 shows very diagrammatically, an exemplary embodiment of an inking unit of a printing machine which is suitable for performing the method according to the invention. The printing unit includes, as an ink source, an ink duct or fountain 10 having a number of setting elements in the form of doctor blades 11 which are located close beside one another in the longitudinal direction of the ink fountain 10. The setting of the doctor blades 11 against a first roller 12*a* of an ink transport device can be controlled separately for each doctor blade by metering variables, which are applied to the ink source in the form of electrical signals by a control unit 18. Instead of individual doctor blades, a flexible ink knife can also be used, which can be adjusted, by a number of actuators acting thereon, to ink zone openings which vary across the width of the ink fountain 10. The ink film applied to the roller 12*a* by the ink fountain 10 has eight zones here, corresponding to the number of doctor blades 11, the zones lying next to one another in the transverse direction of the roller 12*a*; the thickness of the applied ink film for each zone depends upon the setting of the corresponding doctor blade and may be different from one another. A typical number of zones for a printing machine of about 1 m printing width is 32.

If the color separation of the subject has been subdivided into zones, a corresponding zone pattern must also be produced on the transport device. Dividing up the zones in the transverse direction is performed by predefining metering variables for each individual doctor blade or for each individual actuator, as described hereinabove.

The first roller 12*a* rotates in contact with a second roller 12*b*. The latter performs, simultaneously with the rotational movement thereof, an oscillatory movement parallel to the axis of rotation thereof, by which the second roller 12*b* rubs against the first roller 12*a* and a following roller 12*c*. This rubbing movement has the effect of interchanging ink between adjacent zones, respectively illustrated separately on the rollers by broken lines. A roller 12*d* following the roller 12*c* forms the last element of the transport device; it transfers the ink layer to a printing form 15, here having the form of a further roller. 19 is a blanket cylinder. A dampening-solution source for metering a dampening solution zonally onto the transport device is likewise provided, but is not illustrated in FIG. 2, in the interest of clarity. In practice, the number of rollers of the transport device is greater than is illustrated here, amongst other things, in order to emulsify ink and dampening solution on the paths thereof to the printing form.

In FIG. 2, the zones of the rollers, defined by the individual doctor blades 11 of the ink fountain 10, are respectively distinguished from one another by broken lines on the rollers. Whereas, in the case of the first roller 12*a*, due to the type of ink application, abrupt changes in the thickness of the ink layer can occur at the boundaries between two zones, these changes are balanced out and made continuous by the oscillating second roller 12*b*.

For the purpose of color control, a measured value device, for example a camera 17, is directed towards a printed sheet 16 emerging from the printing machine, and evaluates the colors in specific sections of the printed image. These sections can be predefined by the control unit 18. The results of the evaluation are routed to the control unit 18 which, if necessary, determines a color deviation from the original image and then performs a correction to the metering variables.

Figure 3:
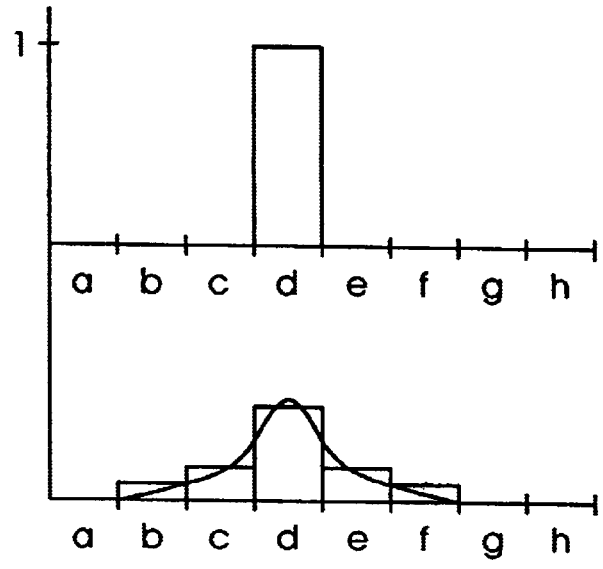
FIG. 3 is a plot diagram showing the distribution, into adjacent zones of the transport device of the printing machine, of ink applied in one zone of the transport device of the printing machine.

The exchange of ink which takes place during the distribution in the transport device is illustrated schematically in FIG. 3. An ink layer which is applied by the ink fountain 10 with a thickness of 1 unit in a zone d of the first roller 12*a* (note the upper horizontal of FIG. 3) is partially distributed to adjacent zones by the rubbing movement of the roller 12*b*. At the transition from the third or last roller 12*d* to the printing form 15, the ink layer has been given the shape illustrated as a continuous curve 30 at the lower horizontal of FIG. 3. This shape corresponds to a retention of about 50% of the ink layer in the original zone d, a transfer of about 20%, respectively, to the nearest adjacent zones c and e and a transfer of about 5%, respectively, to the next-but-one adjacent zones b and f, as shown by the histogram bars at the lower horizontal of FIG. 3. Of course, the numerical examples cited here have been selected purely arbitrarily; depending upon the intensity of the rubbing movement, the extent of the exchange of ink between the zones or the width of the curve 30 may vary. In addition, the zonal area coverage influences the extent of the ink exchange, because the average residence time of the ink and, therewith, the average number of splitting passes of an ink particle before it is printed, depends upon the area coverage.

Figure 4:
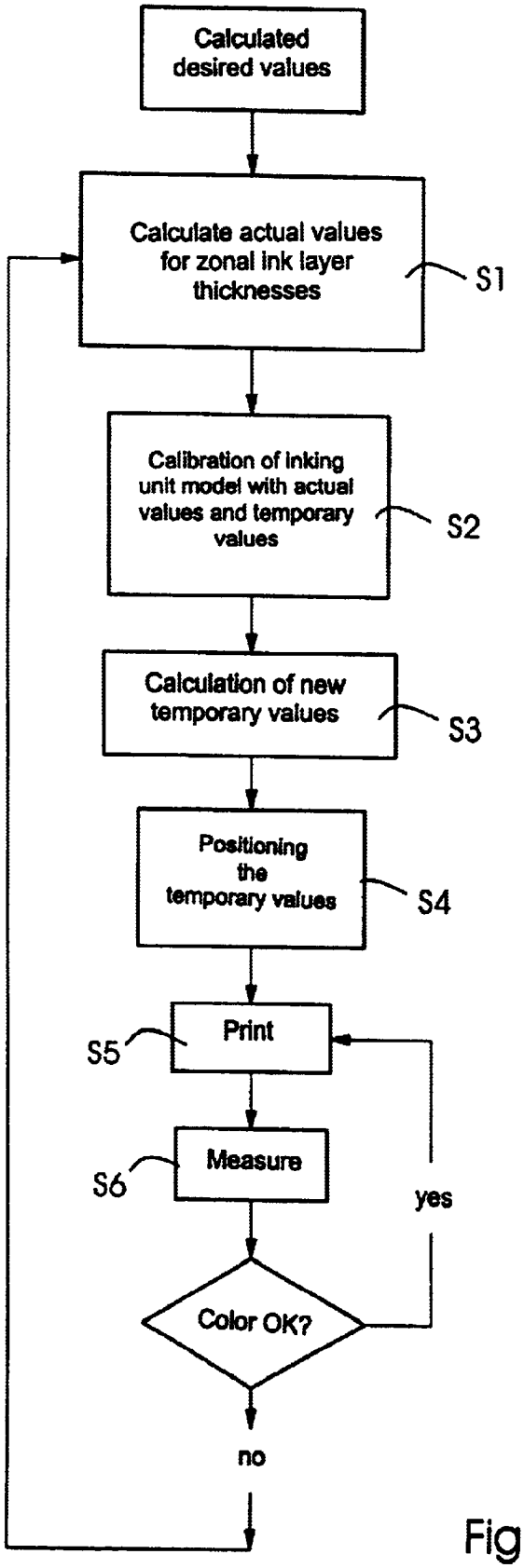
FIG. 4 is a flow chart of the control system according to the invention.

FIG. 4 is a flow chart of the method according to the invention for controlling parameters of the ink layer transferred to the printing form. Starting from a given subdivision of a printing original into zones, in step S1, for each zone parameter such as area coverage or, with the same significance as the latter, a layer thickness at the output of the inking unit, is calculated, as required for a high-quality color reproduction.

If the method is used for print presetting, the calculation can be based merely on image data from the printing original, while, in the case of production printing, the inclusion of measured color deviations between a desired or nominal and an actual printing result is needed.

What is important for the invention of the instant application is that the parameters calculated in this manner cannot be used directly for the control of the ink application from the ink fountain to the first roller of the transport device, because, in the course of the transport of the ink layer via the rollers to the printing form, the parameters of the ink layer can change. In step S3, therefore, optimization is provided, which supplies parameter values for the ink layer which the latter must have as it is applied to the first roller 12*a* in order that an ink layer having the originally desired or nominal parameters is transferred to the printing form 15. The parameter values obtained by the optimization are referred to hereinbelow as temporary values; the parameter values which the ink layer is to have when it is transferred to the printing form are referred to as desired or nominal values.

Figure 5:
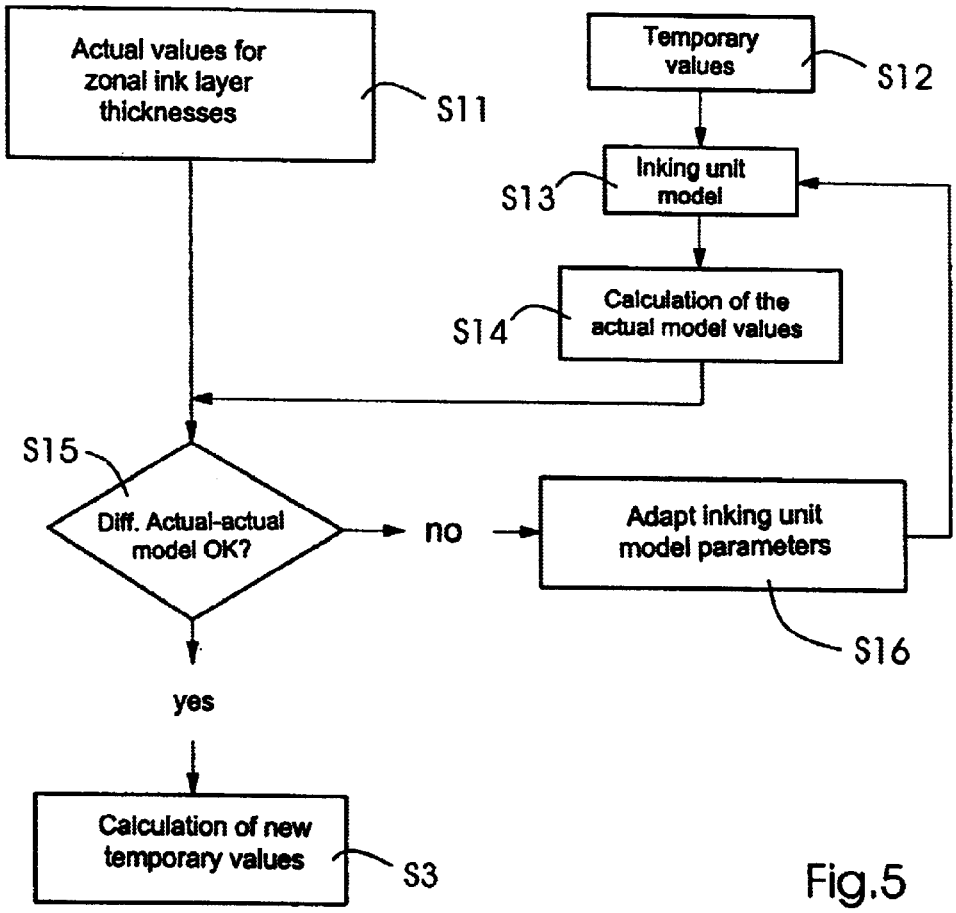
FIGS. 5 and 6 are two different modes of one step of the method from FIG. 4.

Before these desired or nominal values can be used to calculate the temporary values, according to a different mode of the method, it is necessary to record the laws governing relationships between the two by a calibration (step S2) of the inking-unit model. For this purpose, actual values of the zonal ink layer are registered as the zonal ink layer is transferred to the printing form, as are temporary values set for this purpose (steps S11, S12 in FIG. 5), and the inking-unit model is used to calculate model actual values of the layer thicknesses. In step S15, these are compared with the real actual values and, in the event of an excessively high deviation, the inking-unit model is adapted in S16, by varying free parameters of the model until, for example, the mean square error between the registered actual values and the calculated values supplied by the model, using the associated temporary values, is a minimum.

Such a calibration can be performed, for example, by using a sample printing job, and the calibration obtained in this manner can be used for calculating print presettings; however, it can also continue to run during production printing, so that the calibration is adapted continuously to the running print job.

Figure 6:
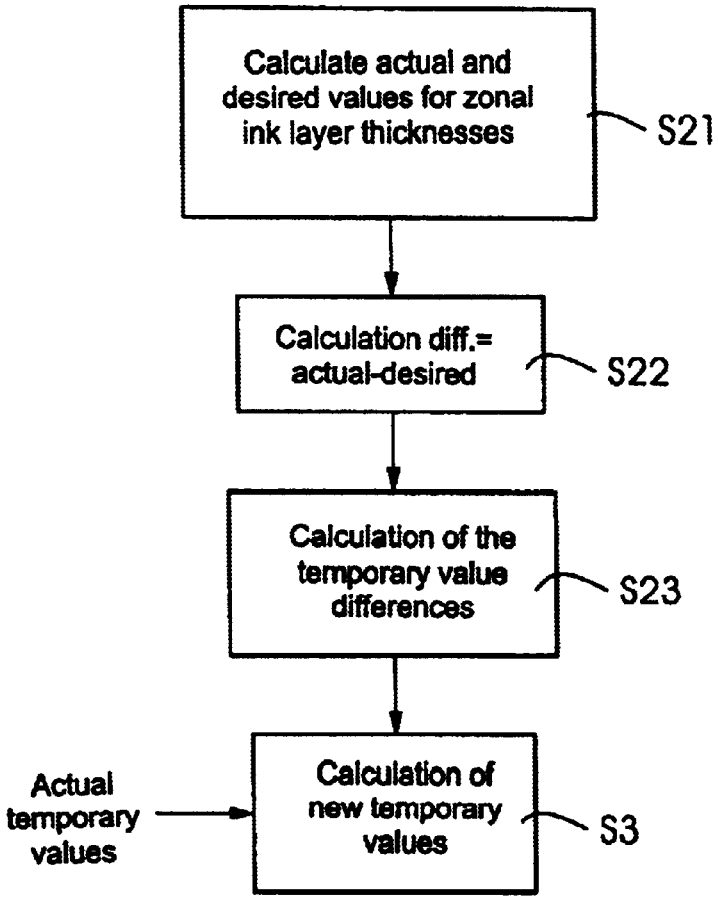

In step S3, this calibration is followed by the calculation of the temporary values. In addition to the calibration described with reference to FIG. 5, which supplies absolute values of the temporary values, it may also be advantageous to use a differential model to determine the temporary values, as illustrated in FIG. 6. Here, in step S21, actual and desired or nominal values for the zonal ink layer thicknesses are calculated, in S22 the difference between the two is determined and used in S23 to determine a corresponding change to the temporary values. Here, the step S3 of calculating new temporary values is reduced to adding the changes determined in S23 to the current temporary values.

Following S3, for example by using empirically determined characteristic curves of the inking unit, metering variables, such as a gap width between a doctor blade 11 and the roller 12*a*, or a contact pressure between a doctor blade and the roller 12*a*, are selected so as to supply an ink layer having the temporary values on the roller 12*a*. These selected metering variables are set on the ink fountain in step S4.

If printing is begun in step S5 with the metering variables set in this manner, very good color reproduction is already to be expected.

However, in a production printing operation, the quality of the color reproduction is expediently monitored continuously (S6). If, for example, with the aid of the camera 17, it is determined that one color appears too weak or too intense on the sheet 16 in a monitored zone of the printed image, a new actual/desired or nominal value calculation is triggered, i.e., the method returns to step S1.

The calculation of the temporary values in step S3 proceeds as described hereinbelow with reference to FIG. 7.

Figure 7:
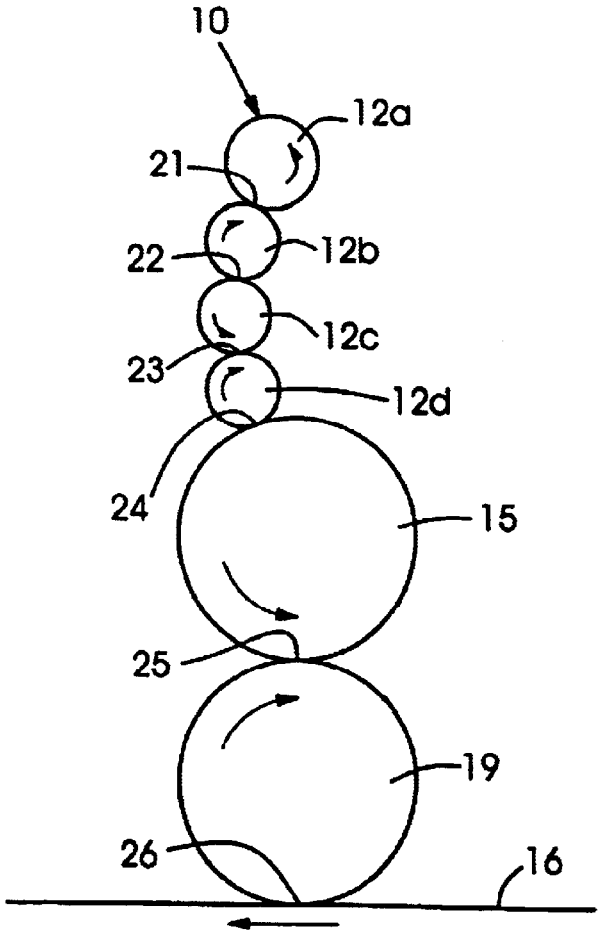
FIG. 7 is a diagrammatic side elevational view of the printing unit of FIG. 2.

The printing machine shown diagrammatically in FIG. 7 corresponds to the printing machine of FIG. 2. The inking unit, which here also includes the roller with the printing form 15 and the blanket cylinder 19, comprises six splitting points 21, 22, 23, 24, 25 and 26, the last splitting point 26 being that between the blanket cylinder 19 and the printing material 16.

In the interest of simplicity, half-and-half ink splitting will be assumed at all the splitting points. The ink layer thicknesses on the various rollers and the printing material are, respectively, designated by SDn, two ink layers, which are located downline of a splitting point and, therefore, are equally thick, respectively, having the same index n. The numerical value of the index n, which is, respectively, associated with a layer thickness at a given location in the printing machine, is selected arbitrarily. Here, in particular, SD1 designates the ink layer on the printing material, and SD7 designates the ink layer metered onto the first roller of the transport device by the ink source 10, symbolized here only by an arrow.

The following is true here, respectively, in each individual zone of the printing machine (without taking into account the transfer of ink from one zone into adjacent zones as a result of distribution):

$$SD1 = \frac{1}{2}(SD2) \tag{1}$$

$$SD2 = \frac{1}{2}(SD3 + SD1)$$

$$SD3 = \frac{1}{2}(SD2 + SD4)$$

$$SD4 = \frac{1}{2}(SD3 + SD5)$$

$$SD5 = \frac{1}{2}(SD4 + SD6)$$

$$SD6 = \frac{1}{2}(SD5 + SD7)$$

Because there are 6 equations and only 7 unknowns, one layer thickness can be selected freely. For example, SD7 can be set arbitrarily to 1. This system of equations can then be transformed to:

$$0 = \frac{1}{2}(SD2) - SD1 \tag{2}$$

$$0 = \frac{1}{2}(SD3 + SD1) - SD2$$

$$0 = \frac{1}{2}(SD2 + SD4) - SD3$$

$$0 = \frac{1}{2}(SD3 + SD5) - SD4$$

$$0 = \frac{1}{2}(SD4 + SD6) - SD5$$

$$0 = \frac{1}{2}(SD5 + SD7) - SD6$$

$$1 = SD7$$

and can be written in matrix form as:

$$y = \begin{pmatrix} 0 \\ 0 \\ 0 \\ 0 \\ 0 \\ 0 \\ 1 \end{pmatrix} = ASD$$

$$A = \begin{pmatrix} 0 & 1/2 & 0 & 0 & 0 & 0 & 0 \\ 1/2 & 0 & 1/2 & 0 & 0 & 0 & 0 \\ 0 & 1/2 & 0 & 1/20 & 0 & 0 & 0 \\ 0 & 0 & 1/2 & 0 & 1/2 & 0 & 0 \\ 0 & 0 & 0 & 1/2 & 0 & 1/2 & 0 \\ 0 & 0 & 0 & 0 & 1/2 & 0 & 1/2 \\ 0 & 0 & 0 & 0 & 0 & 0 & 1 \end{pmatrix}$$

$$SD = \begin{pmatrix} SD_1 \\ SD_2 \\ SD_3 \\ SD_4 \\ \cdot \\ \cdot \\ SD_7 \end{pmatrix}$$

wherein SD is the vector of the layer thicknesses (SD1, . . . , SD7). The number of layer thicknesses SD1 to SD7 to be taken into account is always greater by 1 than the number of rollers involved. This system of equations can be solved for SD by using conventional methods of matrix manipulation:

$$SD = A^{-1}Y$$

$$Y = (0, 0 \ldots, 0, 1)$$

In this way, all the layer thicknesses (SD1, . . . , SD7) can be calculated directly.

If the distribution is taken into account, it is necessary for n equations to be set up for each gap, wherein n is the number of zones.

For the layer thickness SDi,j in the j-th zone at a gap where distribution takes place, it is then true, for example (using the same numerical values of the index n as above), that:

$$SDi,j = a\tfrac{1}{2}(SDk,j-1 + SDl,j-1) + b\tfrac{1}{2}(SDk,j + SDl,j) + c\tfrac{1}{2}(SDk,j+1 + SDl,j+1)$$

wherein SDi,j−1 and SDi,j+1 respectively designate layer thicknesses in zones adjacent to SDi,j.

The factors a, b, c can be determined by adapting the inking-unit model empirically by using printing trials. In this way, n(m−1) equations are obtained, wherein m is the number of splitting points. By adding in the starting value conditions for the layer thicknesses metered in from the ink source, in the form SD7, j=1, j=1, . . . , n, the result is nm equations, which can be combined into a system of equations in a form analogous to the system of equations (1).

By solving this system of equations in matrix form for the vector SD, one obtains a matrix $A^{-1}$ which, for each desired vector of layer thicknesses on the printing material, i.e., for each desired area covering, permits the temporary parameters needed for the production thereof, i.e., the layer thicknesses SD7,j,j=1, . . . , n, to be calculated quickly and simply.

The expansion of the method to any desired number of rollers and splitting points will not present any difficulties to those skilled in the art, based upon the foregoing explanations. Even an expansion to the treatment of satellite rollers, i.e., rollers which contact only one single further roller in the inking unit, or rollers which have more than two splitting points, is readily possible.

In addition, the treatment of ink splitting which is not half and half is possible by using a modification of the method described hereinabove. In such a case, different indices must be allocated for the two ink layers at the outlet of a splitting point, and two equations instead of one are set up for each gap and each inking zone.

We claim:

1. A method of controlling parameters of an ink layer at a selected location in a printing unit of a printing machine, the printing machine including at least one ink source for producing the ink layer on a transport device, whereon metering variables for regulating the application of ink to the transport device are zonally settable, and further including the transport device for transferring the ink layer to the selected location, the method comprising, for each zone of the ink layer, using a subject to be printed for determining desired values of parameters which the ink layer is to have at the selected location, and setting the metering variables of the ink source, based upon the desired values of the parameters, so that the parameters of the ink layer as the ink layer is applied to the transport device have temporary values deviating from the desired values, the deviation being such that an exchange of ink between the zones, taking place in the transport device, leads to the ink layer reaching the desired values of the parameters as the ink layer is transferred to a printing form, including calculating the temporary values with the aid of a system of n times m linear equations, where n is the number of zones and m is a number of splitting points describing the parameters of the ink layer in the entire transport device in a stationary state based upon the temporary values, taking into account the ink splitting and the lateral distribtion.

2. The method according to claim 1, which includes solving the system of equations for the temporary values in order to calculate the temporary values for given desired values.

3. The method according to claim 1, which includes assuming that the ink splitting in the entire printing machine is half and half.

4. The method according to claim 1, which includes applying the method for regulating production printing.

5. The method according to claim 1, which includes applying the method for print presetting.

6. The method according to claim 1, which includes controlling the parameters at the printed sheet.

7. The method according to claim 1, which includes calculating the temporary values while taking into account at least one of the parameters of the ink layer consisting of the thickness and a dampening solution content thereof.

8. The method according to claim 1, which includes using the averages of a degree of coverage of the printing inks for each zone for determining the temporary values.

* * * * *